US006211478B1

(12) United States Patent
Schoenemann et al.

(10) Patent No.: US 6,211,478 B1
(45) Date of Patent: Apr. 3, 2001

(54) SWITCHING ARRANGEMENT AND METHOD FOR ITS PRODUCTION

(75) Inventors: Thomas Schoenemann, Buchs; Lukas Zehnder, Baden-Dättwil, both of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/374,984

(22) Filed: Aug. 16, 1999

(30) Foreign Application Priority Data

Aug. 21, 1998 (DE) ..... 198 37 945

(51) Int. Cl.[7] ..... H01H 9/30; H01H 1/02

(52) U.S. Cl. ..... 218/16; 218/48; 218/65; 218/146

(58) Field of Search ..... 200/262–270; 218/16–21, 30–33, 48–50, 65, 74, 107, 108, 123–133, 146, 147

(56) References Cited

U.S. PATENT DOCUMENTS

| | | | | |
|---|---|---|---|---|
| 3,752,946 | * | 8/1973 | Bailey et al. | 200/267 |
| 3,801,760 | | 4/1974 | Korte . | |
| 4,628,164 | * | 12/1986 | Talpo | 218/65 |
| 5,597,064 | * | 1/1997 | Ozaki et al. | 200/269 |
| 5,869,796 | * | 2/1999 | Matsuda et al. | 218/48 |
| 5,902,978 | * | 5/1999 | Zehnder et al. | 218/48 X |
| 5,905,243 | * | 5/1999 | Zehnder et al. | 218/54 |
| 5,929,409 | * | 7/1999 | Zehnder et al. | 218/48 |

FOREIGN PATENT DOCUMENTS

| | | |
|---|---|---|
| 2337171 | 4/1975 | (DE) . |
| 2945450A1 | 5/1981 | (DE) . |
| 3031583A1 | 2/1982 | (DE) . |
| 3247054C1 | 5/1984 | (DE) . |
| 4112749A1 | 1/1992 | (DE) . |
| 4315813A1 | 11/1994 | (DE) . |
| 4317350C2 | 12/1994 | (DE) . |
| 19613568A1 | 10/1997 | (DE) . |

* cited by examiner

*Primary Examiner*—J. R. Scott
(74) *Attorney, Agent, or Firm*—Burns, Doane, Swecker & Mathis, L.L.P.

(57) ABSTRACT

In a power switch, power-switch fingers of a rated-current switching arrangement, as well as contact fingers (25) of a tulip contact and a switching pin (14) of an arcing switch arrangement, or other parts, each comprise a base body (26, 28) which, at sections which are subjected to high thermal loads by the arc formation, bears a protective layer (27, 29) which is resistant to contact erosion and has been applied to the base body (27, 28) by plasma spraying in vacuum. This enables even complex and flexible parts to be made resistant to contact erosion. The protective layer (27, 29) which is preferably used is a mixture of at least 10% (by weight), in particular at least 50% (by weight) of high-melting metal, such as W, Mo, Ir, and lower-melting metal, such as Cu, Ag, Ti, Fe, e.g. 80% (by weight) W and 20% (by weight) Cu, while the base body used is preferably made from Cu, Ag. Fe, steel, Al or a flexible copper alloy, such as CuBe, CuCr or CuCrZr.

20 Claims, 5 Drawing Sheets

SWITCHING ARRANGEMENT AND METHOD FOR ITS PRODUCTION

BACKGROUND OF THE INVENTION

1. Field of the Invention

The invention relates to a switching arrangement in particular for power switches such as those which are used in power plants, transformer substations and other electrical power supply facilities, in order to switch operating and excess currents on and off, and to a method for its production.

2. Discussion of Background

Switching arrangements of the generic type are known, in which in particular parts of switching contacts on which the roots of the arc which is formed during switching are situated consist of material which is particularly resistant to contact erosion. Such material is usually produced by sintering a mixture of metal powders e.g. tungsten as a high-melting component and copper as a lower-melting component. This sintered material is relatively difficult to process. In particular, it is extremely brittle and can only be shaped by means of processors which remove metal. It cannot be welded in a customary manner and can only be joined to other materials by comparatively complicated processes, for example by having copper cast behind it, by friction welding, by flush butt welding or electron beam welding or by soldering which, however, produced a comparatively weak joint, or may be removably joined by means of a screw connection, which, however, requires complicated machining. The provisions of parts or coatings which are resistant to contact erosion therefore generally requires a high level of outlay.

Since in practice the material which is resistant to contact erosion cannot be deformed, the possibilities for shaping a base body which is to be provided with a coating which is resistant to contact erosion are extremely limited. Owing to the brittleness of the material, it is also impossible to provide flexible parts with a coating which is resistant to contact erosion. For these reasons, it is generally deemed sufficient, for example, to use tips of switching pins, arcing rings and similarly simple parts which are made from material which is resistant to contact erosion. Other parts of the arcing chamber and areas which adjoin the latter, which are also exposed to the hot gases generated when opening the switch, on the other hand, remain unprotected.

SUMMARY OF THE INVENTION

Accordingly, one object of the invention is to provide a novel switching arrangement of the generic type which is easy to produce, and a method for its production.

The advantages which are achieved by the invention are, in addition to the fact that the switching arrangement, in particular its parts which are resistant to contact erosion, are easier to produce, lie primarily in the fact that there are considerably wider options for the application of protective layers which are resistant to contact erosion. For example, according to the invention protective layers can be applied to parts of virtually any desired shape in a variable thickness and even with a variable composition. Due to their greater flexibility, protective layers can even be applied to flexible, in particular elastically deformable parts without the flexibility of these parts being significantly impaired and without there being any risk of crack formation in the protective layer.

The possibility of applying protective layers which are resistant to contact erosion to virtually any desired surfaces according to local requirements eliminates significant restrictions on the design of switching arrangements, in particular of the switching contacts, and makes it possible to implement designs which otherwise would have limited or no suitability for practical applications. As a result, there is considerably greater freedom when designing switches.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
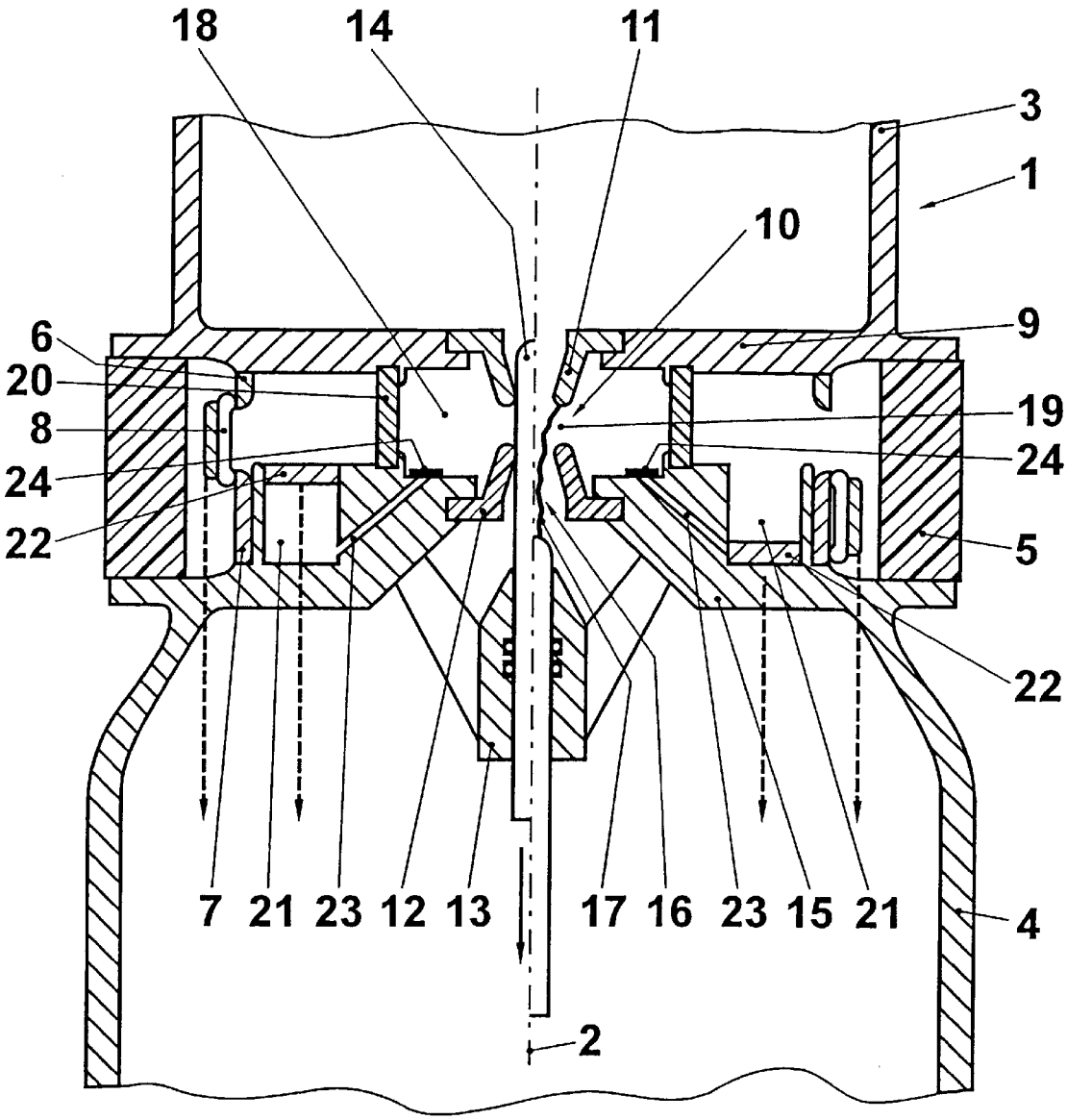
FIG. 1 shows an axial longitudinal section through a power switch having switching arrangements according to the invention, in the switched-on position on the left and in the switched-off position on the right.

Referring now to the drawings, wherein like reference numerals designate identical or corresponding parts throughout the several views, the power switch which in FIG. 1 is shown in the switched-on position on the left and in the switched-off position on the right and can be used, for example, as a generator switch has housing 1, which is essentially rotationally symmetrical. about a switching axis 2 and has an upper housing part 3 and a lower housing part 4, both made from metal, which are connected by a cylindrical, central housing part 5 made from insulating material. The housing parts 3, 4 are each connected to the opposite voltage-carrying terminals of the power switch.

At the level of the central housing part 5, a rated-current switching arrangement is arranged on the outside, which switching arrangement comprises circumferential, fixed rated-current contacts, which respectively adjoin the upper housing part 3 and the lower housing part 4 and are spaced apart from one another in the axial direction, namely an upper fixed rated-current contact 6 and a lower fixed rated-current contact 7, as well as a movable rated-current contact 8 with contact fingers which follow one another in the circumferential direction and, in the switched-on position, in each case bridge the distance between the fixed rated-current contacts 6, 7. The movable rated-current contact 8 is connected to a switching drive (not shown), by means of which it can be displaced in the axial direction between the switched-on position, in which it bridges the gap between the upper fixed rated-current contact 6 and the lower fixed rated-current contact 7, and the switched-off position, in which it is at a distance from the upper fixed rated-current contact 6.

At the bottom, the upper housing part 3 is closed off by a horizontal partition 9. This partition supports the fixed part of an arcing switch arrangement 10. In a central opening in the partition 9, there is a tulip contact 11, as first switching contact, with a plurality of elastic contact fingers which follow one another in the circumferential direction, are directed obliquely downward and toward the switching axis 2 and are separated by slots. A nozzle 12 which surrounds the switching axis 2, is made from electrically insulating material and is in the shape of a funnel which tapers upward, is arranged opposite the tulip contact 11. A switching pin 14, which can be moved in the axial direction by means of the switching drive and, in the switched-on position, projects into the tulip contact 11 and on the outside is in contact with the contact fingers of said tulip contact, is mounted as the second switching contact in a slideway 13, which is arranged in the lower housing part 4 and also produces a connection with good electrical conductivity. In the switched-on position, the contact fingers are elastically deformed slightly, so that they exert a comparatively high contact pressure on the switching pin 14. The slideway 13 is secured to a partition 15 which closes off the lower housing part 4 at the top. The nozzle 12 is attached in a central opening in the partition 15.

In the switched-off position, the switching pin 14 is pulled downward, so that its tip lies beneath the nozzle 12. An arcing chamber 16 is then formed between the tulip contact 11 and the switching pin 14, in which chamber an arc 17 has formed between the said switching contacts during the switching-off operation. The arcing chamber 16 is surrounded by a continuous annular heating volume 18 which is connected to the arcing chamber by the gap which separates the tulip contact 11 from the nozzle 12 and forms an encircling blowing slot 19. On the outside, the heating volume 18 is closed off by an encircling wall 20 made from insulating material. A plurality of, for example four, blowing cylinders 21 are distributed over the circumference of the partition 15 and have blowing pistons 22, which can be actuated by the switching drive and are connected to the heating volume 18, in each case via blowing channels 23. Nonreturn valves 24 are fitted at each of the openings of the blowing channels 23 leading into the heating volume 18.

In order for the arrangement to be switched off, the movable rated-current contact 8 and the switching pin 14 are pulled downward. The movable rated-current contact 8 is disconnected from the upper fixed rated-current contact 6, so that the current from the rated-current switching arrangement is switched to the arcing switch arrangement. When the switching pin 14 is disconnected from the tulip contact 11, the arc 17 is then drawn which, when the switching pin 14 has reached the switched-off position, connects the tulip contact 11 to the tip of the switching pin 14 through the nozzle 12. As a result of the heat which emanates from the arc 17 and the pumping action of the blowing cylinders 21, the pistons 22 of which were moved downward together with the switching pin 14, a high pressure builds up in the heating volume 18, which pressure generates a strong flow of arc-extinguishing gas through the tulip contact 11 and the nozzle 12 and extinguishes the arc 17 at the next current zero crossing.

The tulip contact 11 (FIG. 2*a*), as the first switching contact of the arcing switch arrangement, comprises individual contact fingers 25 which surround the switching axis 2. They are elastically deformable to a slight extent and their tips, in the switched-on position, are deflected outward slightly by the contact with the switching pin 14, thus ensuring sufficient contact pressure. The tulip contact 11 has a base body 26 which is made from copper or another suitable material and the surface of which, in the area of the contact fingers 25, lies below the final dimension of the surface and, in the area, bears a protective layer 27 which is resistant to contact erosion and fills up the difference with respect to the final dimension. The protective layer 27 is produced by means of the plasma-spraying process which is well known from other technical fields. The composition of the protective layer may substantially correspond to that of the conventional material which is resistant to contact erosion.

The switching pin 14, which is the second switching contact of the arcing switch arrangement, also comprises a base body 28, which is made, for example, from a copper alloy or some other known material which is suitable for the purpose, and the surface of which, at the tip and in the adjoining area which lies below the final dimension of the surface, said final dimension only being produced by means of a protective layer which is again applied to the base body 28 by means of plasma spraying. At the tip of the switching pin 14, the protective layer 29 forms a relatively solid cap which tapers into a somewhat thinner casing. In accordance with FIG. 2*a*, the casing extends beyond the contact area with which the contact fingers 25 of the tulip contact 11 are in contact in the switched-on position.

Figure 2A:
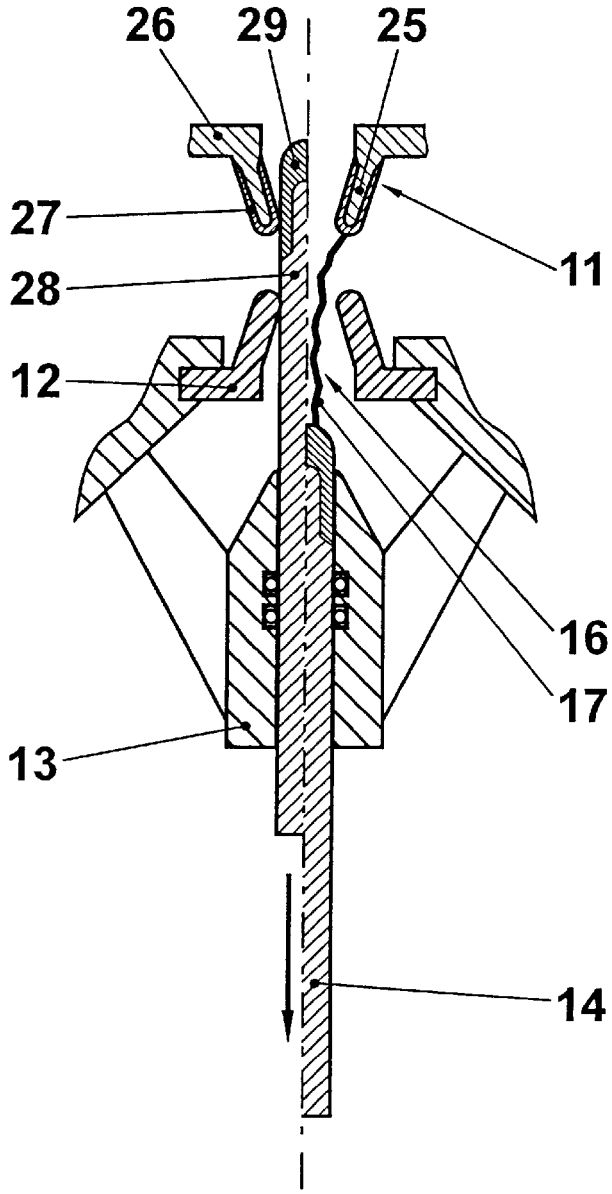
FIG. 2*a* shows an enlarged view of an axial longitudinal section through an arcing switch arrangement of the power switch in accordance with FIG. 1.
Figure 2B:
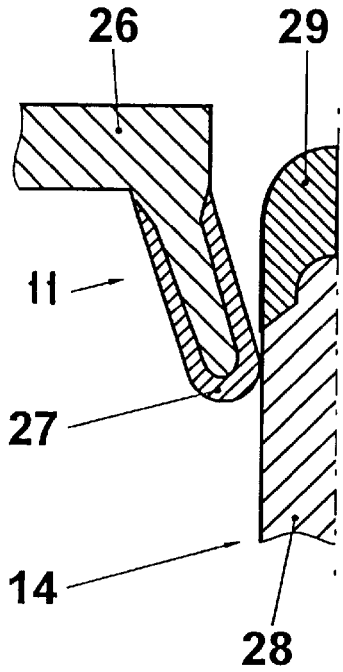
FIG. 2*b* shows an enlarged, slightly modified view of a detail from the arcing switch arrangement in accordance with FIG. 2*a*.

FIG. 2*b* shows a slightly different design of the protective layer 29, according to which it stops in front of this contact area. Since the conductivity of the protective layer 29 is less than that of the base body 28, the contact resistance is consequently lower and it is easier to switch the current to the arcing switch arrangement. Since, in the arcing switch arrangement outlined above, hot gases flow through the tulip contact 11 while the arrangement is being switched off, it is recommended for the protective layer of said tulip contact to extend at least onto the front area and the inside. In the case of the switching pin 14, on the other hand, the areas which lie slightly further behind the tip are not subjected to high loads and generally do not require a protective layer. In the case of switching arrangements in which those parts of the two switching contacts which lie behind the front areas are not subjected to relatively high loads, it is conceivable for the protective layers not to extend as far as the contact area of both sides, thus reducing the contact resistance further.

The extent and thickness of the protective layers 27, 29 can be adapted with great accuracy to the requirements which are dependent on the load on the switching contacts. In general, it is sufficient for protective layers to be applied to the disconnection areas of the switching contacts, at which they detach from one another when the arrangement is being switched off and where arc roots are first formed, and at the front areas which lie opposite one another in the switched-off position and between which, consequently, the arc burns and which are subjected to particularly high loads from radiation and hot gases. However, it is also quite possible and, under certain circumstances, sensible for other parts of the arcing chamber, such as for example wall sections, also to be protected from arc-heated gases by means of a protective layer which is resistant to contact erosion and is applied by means of plasma spraying.

Figure 3A:
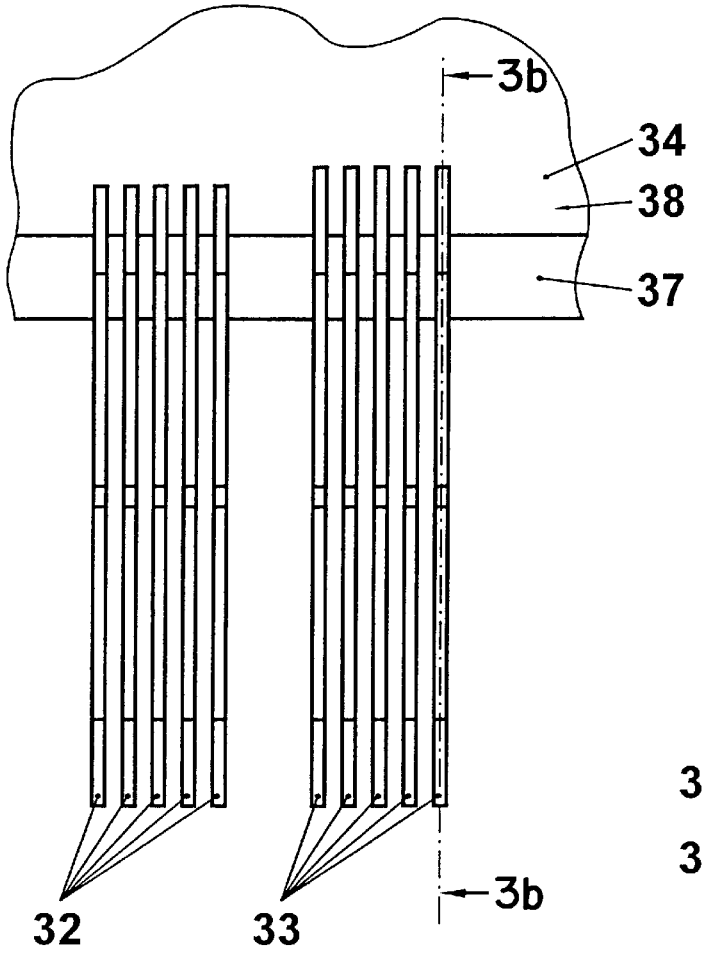
FIG. 3*a* shows a diagrammatic, enlarged view of an excerpt from a rated-current switching arrangement of the power switch in accordance with FIG. 1, radially from the outside and in the switched-on position.
Figure 3B:
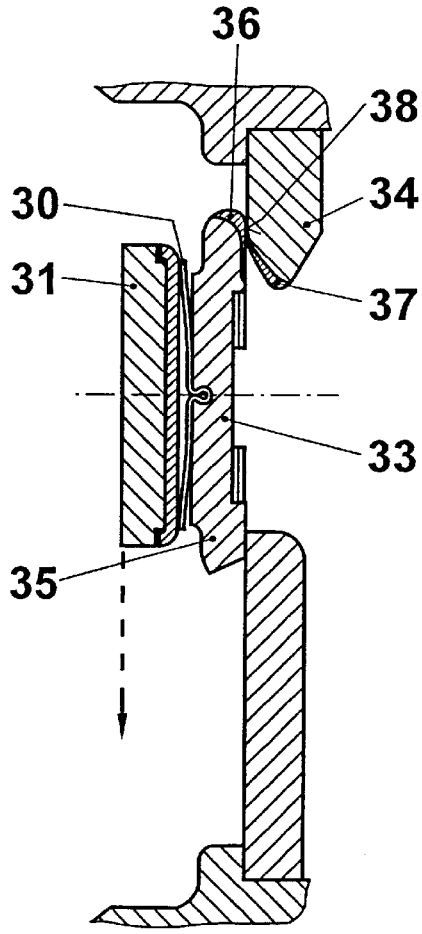
FIG. 3*b* shows, on a smaller scale, a section on 3*b*—3*b* in FIG. 3*a*.

The rated-current switching arrangement of the power switch in accordance with FIG. 1 comprises the upper fixed rated-current contact 6 as the first switching contact and the movable rated-current contact 8 as the second switching contact. The latter has (FIGS. 3*a*, 3*b*) several hundred parallel contact fingers which are distributed over the circumference of the rated-current switching arrangement and, combined to form groups of a plurality of contact fingers, are in each case mounted on an axially displaceable support ring 31 by means of a pressure spring 30. In this case, a plurality of groups of contact fingers 32 are in each case followed by one group of slightly longer power-switch fingers 33. The upper fixed rated-current contact 6 is designed as a contact ring 34, against the outside of which the contact fingers 32 and the power-switched fingers 33 bear in the switched-on position.

Figure 3C:
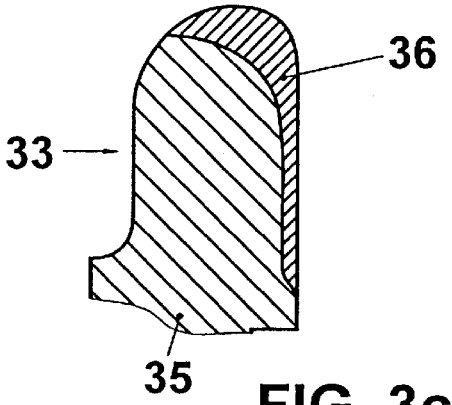
FIG. 3*c* shows an enlarged view of an excerpt from FIG. 3*b*.

In turn (FIG. 3*c*), the power-switch fingers 33 comprise a base body 35 which, on the spherical cap facing toward the contact ring 34, has a protective layer 36 which is resistant to contact erosion and is again applied by means of plasma spraying. The same applies to the contact ring 34 which, on its switched-off-side edge has a protective layer 37 which on the outside is drawn slightly upward. Above the protective layer 37, the contact ring 34 has a silver-coated contact zone 38 which, in the switched-on position, is in contact not only with the power-switch fingers 33 but also with the slightly shorter contact fingers 32, which are likewise silver-coated. The rated-current switching arrangement has a very high continuous current-carrying capacity and a very low contact resistance.

When the arrangement is being switched off, firstly, the contact fingers 32 are disconnected from the contact ring 34, after which the current switches entirely onto the power-switch fingers 33. When the latter are also disconnected from the contact ring 34, an arc is formed between the disconnection areas at the ends of the power-switch fingers 34 and at the edge of the contact ring 34 before the current switches completely to the arcing switch arrangement, the protective layers 36 and 37 ensuring that the contact erosion is kept within tight limits.

The following text describes two further examples of arcing switch arrangements, in which particular options which the invention opens up are employed. In particular, they comprise switching contacts which, in order to utilize electromagnetic forces so as to increase the contact pressure, are of complex form and are to some extent flexible, but at the same time are provided with a protective layer which is resistant to contact erosion and substantially meets the requirements. In particular, they have switching pins, each with a resistant section which adjoins the tip, has a protective layer on the outside and is divided into two or more parallel or antiparallel conductor elements.

Figure 4A:
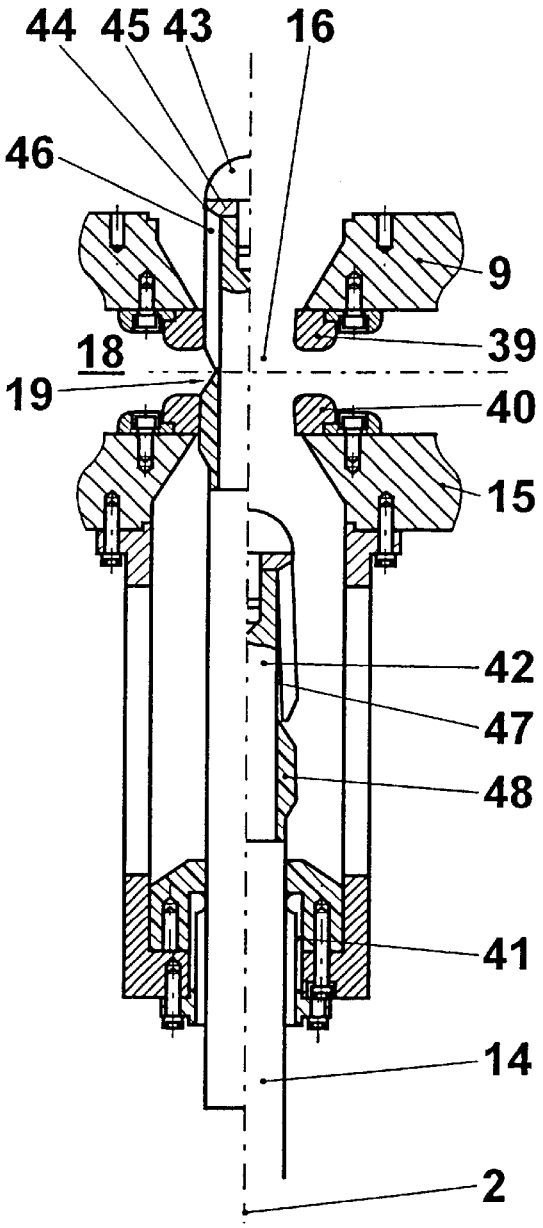
FIG. 4*a* shows an axial longitudinal section through a further switching arrangement according to the invention, in the switched-on position on the left and in the switched-off position on the right.
Figure 4B:
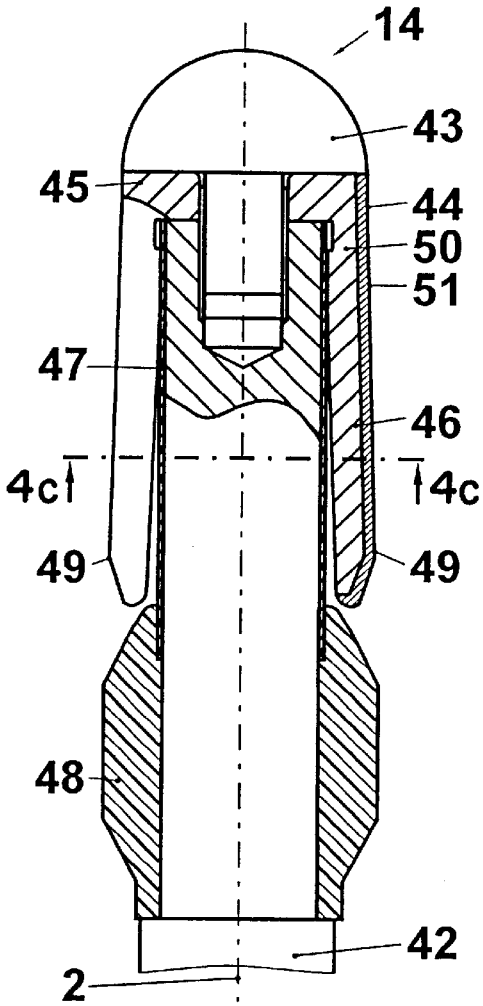
FIG. 4*b* shows an enlarged view of an axial longitudinal section through part of the arcing switch arrangement in accordance with FIG. 4*a*, corresponding to a section on 4*b*—4*b* in FIG. 4*c*.
Figure 4C:
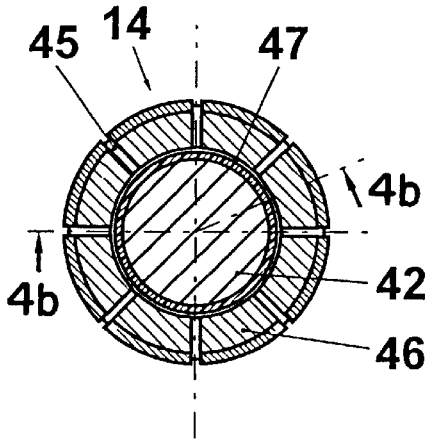
FIG. 4*c* shows a section on 4*c*—4*c* in FIG. 4*b*.

A second embodiment according to the invention of an arcing switch arrangement of a power switch, which is illustrated in FIGS. 4*a*–4*c* in the switched-on position on the left and in the switched-off position on the right, and, e.g. in the power switch in accordance with FIG. 1, can replace the first embodiment of an arcing switch arrangement according to the invention illustrated in FIGS. 1 and 2*a*, 2*b*—the corresponding components therefore bear the same reference numerals—again has an annular heating volume 18 inside a housing which is rotationally symmetrical about a switching axis 2 and is made from insulating material, which heating volume surrounds a first switching contact, which is connected to the first electrical terminal, and a second switching contact. The first switching contact is designed as a first switching ring 39 which is attached to the underside of the partition 9, and the second switching contact is designed as a switching pin 14. A second switching ring 40, which is attached to the top side of the partition 15, is arranged opposite at a distance from the first switching ring 39, in such a manner that an arcing chamber 16, which is connected to the heating volume 18 via an encircling blowing slot 19, is located between these switching rings, which are arranged concentrically with respect to the switching axis 2.

Further down the switching pin 14 is surrounded by a tulip slide 41 which, like the second switching ring 40, is connected to the second electrical terminal. The switching pin 14 has a carrier, which is designed as a central mandrel 42 and into the tip of which a cap 43 is screwed, which cap is made from material which is resistant to contact erosion and clamps a sleeve 44 made from highly conductive spring-elastic material, in particular a ring 45, at its front end. A group of eight elongate contact fingers 46, which are arranged at the same level on the switching pin 14, are separated by slots and project toward the rear, so as to surround the mandrel 42 approximately parallel to the latter, starts from the ring 45. The mandrel 42 is surrounded, from the cap 43 to beyond the ends of the contact fingers 46, by an insulation sleeve 47, which is overlapped by a thicker insulation ring 48.

In the switched-on position, the contact surfaces 49 which lie just before the ends of the contact fingers 46 are in contact with the inside of the first switching ring 39. The switching pin 14 substantially fills the opening of said first switching ring, as well as that of the second switching ring 40, in which the insulation ring 48 is located. The current path runs from the first switching ring 39, via the contact surfaces 49, into the contact fingers 46 and, through the latter, to the ring 45 and on through the mandrel 42 and the tulip slide 41. The front part of the mandrel 42, which is surrounded by the contact fingers 46, forms one conductor element which carries a current which is antiparallel to the currents in the contact fingers 46, which likewise form conductor elements and to which it is electrically conductively connected by the ring 45. The resultant electromagnetic repelling force between the mandrel 42 and the contact fingers 46 spreads the latter apart and presses their contact surfaces 49 against the inside of the first switching ring 39. The resultant contact forces, as well as the opposite contact-disconnection forces which are oppositely directed thereto, intensify as the current intensity increases, resulting in a compensation of the forces which is independent of the current intensity.

During the first phase of the switching-off movement, that area of the switching pin 14 which is in contact with the first switching ring 39 moves toward the cap 43, so that the length of the antiparallel current paths decreases relatively quickly as, at the same time, do the contact forces. When the switching pin 14 is pulled out of the first switching ring 39, an arc forms between the latter and the cap 43. When the cap 43 moves past the second switching ring 40, the arc root jumps from the cap onto the second switching ring, so that the arc then burns between the first switching ring 39 and the second switching ring 40. The air is blown out of the heating volume 18 and is extinguished at the next zero crossing of the current.

The first switching ring 39, the second switching ring 40 and the cap 43, since these are simple rigid parts, comprise solid material which is resistant to contact erosion and has been produced in a known way by sintering. However, they could also, in a similar manner to the tip of the switching pin in accordance with FIG. 2*b*, in each case comprise a base body which is made, for example, from a copper alloy and bears a protective layer of material which is resistant to contact erosion applied by plasma spraying.

The flexible sleeve 44, which is of more complicated shape, is, at any rate, composed of a base body 50 and a protective layer 51 which forms its outer surface and is made from material which is resistant to contact erosion, applied to the base body 50 by plasma spraying. The base body 50 comprises an elastic material of good conductivity. The protective layer 51 is sufficiently flexible to follow the elastic deformations to which the contact fingers 46 are subjected. It is thus possible to protect not only those parts which are subjected to particularly high loads, such as the tip of the switching pin 14, the first switching ring 39 and the second switching ring 40, on which arc roots are formed, but also the entire outside of a resistant section of the switching pin 14, which section is formed by the cap 43, the sleeve 44 and the front part of the mandrel 42 located inside them, and is likewise subjected to high loads from the hot gases which flow out.

In the third embodiment according to the invention of an arcing switch arrangement, which is illustrated in FIGS. 5*a*–5*d* and otherwise corresponds to the second embodiment, the attraction between parallel currents is used to apply the necessary contact forces. The switching pin 14 has two parallel, elastically flexible extensions 52*a*, 52*b*, which adjoin the end of the carrier which is again designed as a mandrel 42 and are separated from one another by a slot 53. At the end, each of the extensions 52*a*, 52*b* has a contact piece 54*a* or 54*b* respectively with a contact surface 49 for making electrical contact with the inner surface of the first switching ring 39, to which it is connected, by means of a connection piece 55*a* or 55*b*, in such a manner that each of the contact pieces 54*a*, 54*b* is offset through 180° from the respective extension 52*a* or 52*b* with reference to a switching-pin axis which coincides with the switching axis 2. The connection pieces 55*a, b* are designed as short screw sections which form half a turn.

The contact pieces 54*a*, 54*b* are separated from one another by a continuation 53' of the slot 53. Together, they have a polygonal cross section, in this example a dodecagonal cross section. The first contact piece 54*a* runs out into the hemispherical tip of the switching pin 14. Apart from this difference, the parts of the switching pin 14, which each comprise an extension 52*a* or 52*b*, a connection piece 55*a* or 55*b* and a contact piece 54*a* or 54*b* and are formed integrally with the mandrel 42 made from highly conductive spring-elastic material, completely correspond to one another.

Figure 5C:
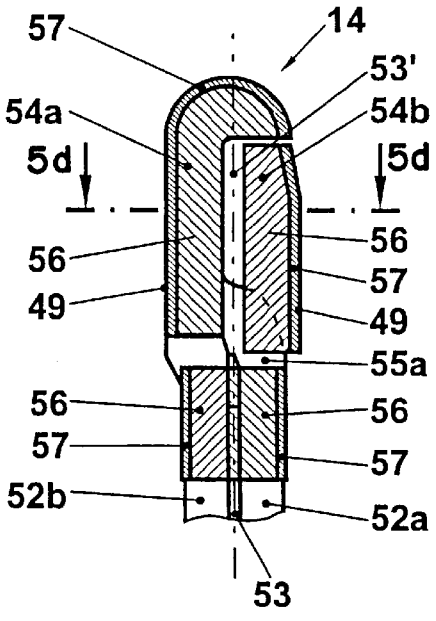
FIG. 5*c* shows an enlarged view of an axial longitudinal section through part of the arcing switch arrangement in accordance with FIGS. 5*a*, 5*b*, corresponding to a section on 5*c*—5*c* in FIG. 5*d*.
Figure 5D:
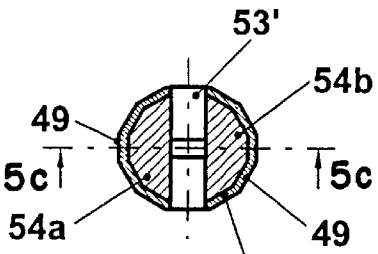
FIG. 5*d* shows a section on 5*d*—5*d* in FIG. 5*c*.
Figure 5B:
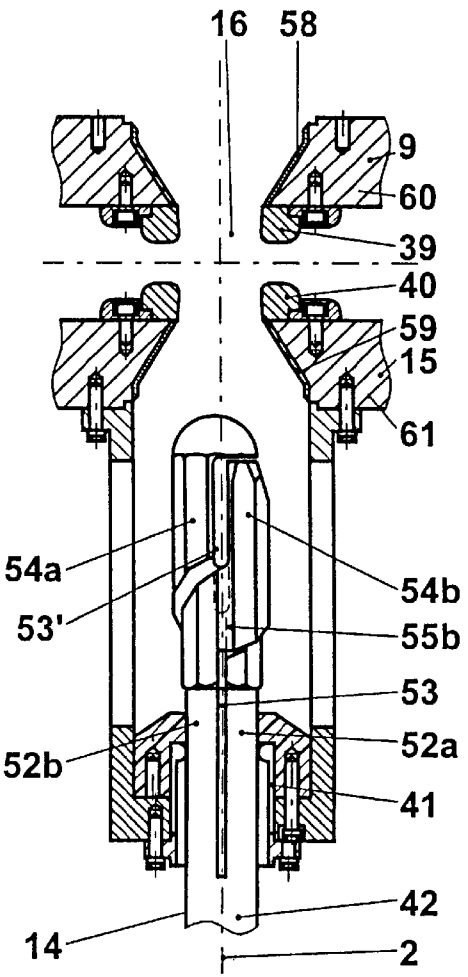
FIG. 5*b* shows the switching arrangement of FIG. 5*a* in the switched-off position.
Figure 5A:
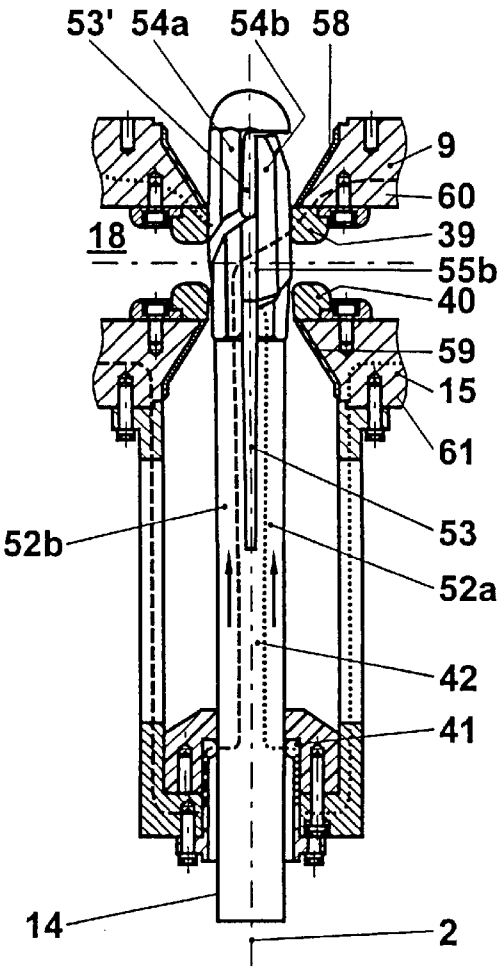
FIG. 5*a* shows an axial longitudinal section through a further switching arrangement according to the invention, in the switched-on position.

In the switched-on position illustrated in FIG. 5*a*, in which the contact pieces 54*a*, 54*b* are pressed slightly toward one another as a result of contact with the first switching ring 39 and the extensions 55*a*, 55*b* are correspondingly spread apart, so that the contact surfaces 49 are pressed against the inside of the first switching ring 39 even by elastic restoring forces, the current path runs through the first switching ring and the contact surfaces 49, into the contact pieces 54*a*, 54*b*, through the latter and the connection pieces 55*a*, 55*b*, the extensions 52*a*, 52*b* and a section of the mandrel 42 and on across the tulip slide 41. The second switching ring 40 is not in contact with the switching pin 14. The two comparatively long extensions 52*a*, 52*b* carry parallel currents and are therefore attracted to one another. As a result, the contact pieces 54*a*, 54*b* which are connected thereto and are offset by 180° with respect thereto are pressed apart, and their contact surfaces 49 consequently press more strongly against the inside of the first switching ring 39. As a result of the polygonal cross section of the switching pin 14 in the area of the contact surfaces 49, it is always in contact with the first switching ring 39 at at least four points.

Shortly after the switching-off movement begins, the contact pieces 54*a*, 54*b* also come into contact with the second switching ring 40, thus partly short-circuiting the current path described above. As a result, the electromagnetic attraction between the extensions 52*a* and 52*b*, and likewise the contact forces generated by this attraction, are reduced. Consequently, the further retraction of the switching pin 14 is not impeded by excessively high friction forces. When the tip of the switching pin 14 is pulled out of the opening of the first switching ring 39, an arc forms between these parts. When the tip of the switching ring 14 then moves past the opening of the second switching ring 40, the arc switches to the latter. It then burns between the first switching ring 39 and the second switching ring 40, is subjected to a blowing action from the heating volume 18 and is extinguished at the next current zero crossing.

In this case too, the first switching ring 39 and the second switching ring 40 comprise, in a conventional way, solid sintered material which is resistant to contact erosion. However, the switching pin 14 again comprises a base body 56 made from highly conductive elastic material which, in the area of the resistant section which is formed by the connection pieces 55*a*, 55*b* and the adjoining contact pieces 54*a*, 54*b* and is divided into two conductor elements, bears a protective layer 57 which is resistant to contact erosion and has been applied by means of plasma spraying. In the area of the tip of the switching pin 14, which tip is subjected to particularly high loads as a result of the arc root, the protective layer is relatively thick, while on the outer surfaces of the contact pieces 54*a*, 54*b* and of the connection pieces 55*a*, 55*b* it is somewhat thinner. It is also conceivable for the hemispherical tip of the switching pin to be designed as a cap made from solid material which is resistant to contact erosion and has been sintered in a customary manner. In any case, the entire outside of the complex-shaped, resistant section of the switching pin 14, along which some of the emerging hot gases flow, is formed by the surface of the protective layer 57 which is resistant to contact erosion.

Since the application of a protective layer which is resistant to contact erosion is considerably simplified by the invention, it is practicable to protect not only parts of switching contacts but also other parts which are subjected to loads from the hot gases generated during the switching-off operation. For example, the encircling wall surfaces of the widening exhaust openings adjoining the arcing rings 39, 40 are likewise formed by protective layers 58, 59 produced by plasma spraying on base bodies 60, 61 of the partitions 9, 15.

During the plasma-spraying process which is used to apply a protective layer which is resistant to contact erosion to a base body, a high electric field is used to generate, from a suitable plasma gas, a plasma into which a powder mixture is introduced by means of a carrier gas. The powder mixture is liquefied and, together with the gas, is accelerated through the electric field toward the base body, onto the surface of which it is sprayed, forming a layer which rapidly solidifies. To avoid oxidation, the plasma spraying is preferably carried out in vacuo.

The resistance to contact erosion of the resultant protective layers is in no way inferior to that of parts which are resistant to contact erosion which have been produced in a conventional manner. The protective layers are also relatively flexible, so that any deformation of the base body is not impeded. The thickness of the layer applied by plasma spraying can be set accurately and variably. Therefore, metal-removing machining is therefore usually only necessary to a slight extent, mainly in order to adjust the surface properties. Above all, it is often useful to reduce the surface roughness by grinding or polishing. The removal of greater volumes of material, for example by milling, is also possible but not usually necessary.

With regard to the composition of the powder mixture which is used in each case to produce the protective layer which is resistant to contact erosion on the base body and which therefore also corresponds to the composition of the protective layer, there are numerous possibilities. The mixture can substantially be adapted to meet the particular requirements. Generally, as with known sintered materials which are resistant to contact erosion, the mixture will normally contain a high-melting component, in order to obtain good resistance to contact erosion, and a lower-melting component which, due to evaporation, contributes to cooling. In most cases, it ought to be advantageous for high-melting metals with a melting point of at least 2000° C., such as W, Mo or Ir, to form at least 10% (by weight), preferably by at least 50% (by weight), while Cu, Ag, Ti, Fe can be used as lower-melting material with a melting point of below 2000° C. As with conventional sintered material which is resistant to contact erosion, a mixture of tungsten and copper has proven particularly successful, particularly at levels of 80% (by weight) tungsten and 20% (by weight) copper. Other copper alloys, in particular with Mo, are also advantageous.

In addition, it is also possible to use protective layers which comprise exclusively high-melting material or—in particular for applications in which the loads are comparatively low—protective layers which do not contain any high-melting components, but rather comprise, for example, only copper with an addition, for example chromium. In fact, very many compositions are possible, provided that the resistance to contact erosion is sufficient for the particular application. For example, in addition to those mentioned above, other suitable constituents of the powder mixture are Au, Ru, Pd, Os, Pt and, in addition, Ni, Cd, Sn, C.

There are also many suitable materials for the base body, which can be selected depending on requirements, such as for example Cu, Ag, Fe, steel, Al or, if high conductivity and, at the same time, elasticity of the material are required, a flexible copper alloy, such as CuBe, CuCr or CuCrZr.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A switching arrangement, comprising:

at least one arcing chamber;

at least one first switching contact and a second switching contact, which are operably engageable and arranged in said arcing chamber so that they can move with respect to one another between a switched-on position, in which they are in contact with one another, and a switched-off position, in which they are isolated from one another;

at least part of surfaces in the arcing chamber being formed by material which is resistant to contact erosion, wherein at least some of the material which is resistant to contact erosion is present in the form of a protective layer which has been applied to a base body plasma spraying; and wherein the protective layer contains at least one high-melting component with a melting point of at least 2000° C. and at least one lower-melting component with a melting point below 2000° C.

2. The switching arrangement as claimed in claim 1, wherein at least the isolating areas of the first switching contact and of the second switching contact, at which the first switching contact and the second switching contact are isolated from one another when the arrangement moves from the switched-on position to the switched-off position, each have a protective layer, (27, 29, 36, 37, 51, 57).

3. The switching arrangement as claimed in claim 1, wherein at least the front area of at least the first switching contact or of the second switching contact, which front area, in the switched-off position, faces toward the respective opposite switching contact, has a protective layer (27, 29, 36, 37, 57).

4. The switching arrangement as claimed in claim 2, wherein the contact area of at least the first switching contact or the second switching contact, which contact area, in the switched-on position, is in contact with the opposite switching contact, does not have the protective layer (29).

5. The switching arrangement as claimed in claim 1, which is designed as an arcing switch arrangement, the first switching contact of which is designed as a switching pin (14) which can be displaced along a switching axis (2) and the tip of which has a protective layer (29, 57).

6. The switching arrangement as claimed in claim 5, wherein at least part of the outside of a resistant section of the switching pin (14), which section adjoins the tip of the switching pin (14), is likewise formed by a protective layer (29, 51, 57).

7. The switching arrangement as claimed in claim 6, wherein the resistant section of the switching pin (14) comprises at least two separate, parallel or antiparallel conductor elements, at least one of which forms part of the outside which is covered by a protective layer (51, 57).

8. The switching arrangement as claimed in claim 7, wherein the conductor elements are designed as contact fingers (46) which in the area of the tip of the switching pin (14) are attached to a central support, project freely toward the rear and surround the support.

9. The switching arrangement as claimed in claim 7, wherein the conductor elements adjoin extensions (52*a*, 52*b*) which project parallel to one another and toward the front, and comprise connection pieces (55*a*, 55*b*), which form approximately half a thread turn, and adjoining contact pieces (54*a*, 54*b*).

10. The switching arrangement as claimed in claim 5, wherein the second switching contact is designed as a tulip contact (11) with a plurality of contact fingers (25) which surround the switching axis (2) and at least the tips of which each have a protective layer (27).

11. The switching arrangement as claimed in claim 10, wherein the contact fingers (25) each have a protective layer (27) at least on their insides.

12. The switching arrangement as claimed in claim 1, which is designed as a rated-current switching arrangement, the second switching contact of which comprises a ring of contact fingers which can be displaced along a switching axis (2), surround said axis and at least some of which are designed as power-switch fingers (33), the tips of which each have a protective layer (36) in the side facing toward the first switching contact.

13. The switching arrangement as claimed in claim 12, wherein the second switching piece is designed as a contact ring (34) which surrounds the switching axis (2) and, at its switched-off-side edge, has a protective layer (37) at least at the areas which interact with the power-switch fingers (33).

14. The switching arrangement as claimed in claim 1, wherein at least one wall surface which delimits the arcing chamber (16) or an area which is connected to the latter is formed by a protective layer (58, 59).

15. The switching arrangement as claimed in claim 1, wherein the high-melting component is present to an extent of at least 10% (by weight), in particular at least 50% (by weight).

16. The switching arrangement as claimed in claim 1, wherein the high-melting component essentially comprises at least one of the following materials: W, Mo, Ir.

17. The switching arrangement as claimed in claim 1, wherein the lower-melting component contains at least one of the following materials: Cu, Ag, Ti, Fe.

18. The switching arrangement as claimed in claim 1, wherein the base body (26, 50, 56) comprises a flexible, in particular elastically deformable material.

19. The switching arrangement as claimed in claim 1, wherein the base body (26, 28, 35, 50, 56, 60, 61) essentially comprises at least one of the following materials: Cu, Ag, Fe, steel, Al, CuBe, CuCr, CuCrZr.

20. The switching arrangement as defined in claim 1, wherein protective layer is composed of 80% by weight of tungsten and 20% by weight of copper.

* * * * *